US006168455B1

(12) United States Patent
Hussaini

(10) Patent No.: US 6,168,455 B1
(45) **Date of Patent: *Jan. 2, 2001**

(54) COAXIAL CABLE CONNECTOR

(75) Inventor: Saied Hussaini, Miami, FL (US)

(73) Assignee: Rally Manufacturing, Inc., Miami, FL (US)

( * ) Notice: Under 35 U.S.C. 154(b), the term of this patent shall be extended for 0 days.

This patent is subject to a terminal disclaimer.

(21) Appl. No.: 09/385,042

(22) Filed: Aug. 30, 1999

(51) Int. Cl.[7] ..... H01R 4/24
(52) U.S. Cl. ..... 439/394; 439/584
(58) Field of Search ..... 439/578, 394, 439/583, 584, 585, 98, 99, 427

(56) References Cited

U.S. PATENT DOCUMENTS

| | | | | |
|---|---|---|---|---|
| 3,951,503 | * | 4/1976 | Caulkins | 439/427 |
| 5,660,565 | * | 8/1997 | Williams | 439/427 |
| 5,681,179 | * | 10/1997 | Lane | 439/427 |
| 5,888,095 | * | 3/1999 | Hussaini | 439/394 |

FOREIGN PATENT DOCUMENTS

| | | | | |
|---|---|---|---|---|
| 578938 | * | 7/1946 | (GB) | 439/427 |

* cited by examiner

*Primary Examiner*—Paula Bradley
*Assistant Examiner*—Briggitte R. Hammond
(74) *Attorney, Agent, or Firm*—Liniak, Berenato, Longacre & White

(57) ABSTRACT

An in-line connector for coaxial cable connectors, which enables two flush cut cables of two different diameters to be spliced together without further cutting of the cable's insulator or outer conductor jacket. A longitudinal connector has an internal concentrically mounted conductor member which contacts the inner wire conductor of each cable to be spliced. A pair of metallic sleeves extend from the conductor and are inserted into each cable to make contact with the woven metallic sheath of each cable. Each of said sleeves comprises two sections having two different internal diameters to accommodate differently sized cables. A collapsible sleeve is concentrically mounted to each end of the connector and engages the connector to inhibit relative rotation. A lock nut threadably engages each of the collapsible sleeves to cover the connection and secure each cable to the connector.

11 Claims, 2 Drawing Sheets

COAXIAL CABLE CONNECTOR

BACKGROUND OF THE INVENTION

1. Field of the Invention

The present invention relates to a coaxial cable connector and more particularly to an in-line coaxial cable connector capable of connecting together two flush cut cables of two different diameters, suitable for use in radio and video signal transmission.

2. Description of the Prior Art

Currently there are numerous connectors which enable two coaxial cables to be spliced together. However, these connectors require the cable to be cut such that the insulating cover is cut back to expose the woven metallic sheath. Additionally, the cable must be cut such that the internal wire conductor extends beyond the remaining portion of the cable to contact a female receptive portion of the cable. This cutting requires the skill of an experienced cable layer and often a cut is made too deep or all the way through the cable. Such an improper cut will require an additional cut thus shortening the length of the cable and wasting the portion which was improperly severed. This type of cutting takes an additional amount of time when attempting to splice together two coaxial cables.

For example U.S. Pat. No. 5,217,392 discloses a coaxial cable splice connector comprising outer conductor shells to make contact with the woven metallic sheath of each cable and an inner conductor bore to make contact with the central wire conductor of each cable. However, the cables to be spliced in U.S. '392 must first be cut to peel back the outer insulator member and expose the woven metallic sheath. Additionally, the cable must be cut such that the inner wire conductors extends past the remaining portion of the cable to engage the inner conductor bore.

There is a need to enable two coaxial cables to be spliced together in-line which requires ease of assembly and simple cut of the cables to be spliced without any reduction in the quality of radio or video reception.

Furthermore, there are various types of radio and video cables on the market having different diameters. Specifically, different makes of coaxial cable have an inner dielectric of varying diameters. Different coaxial cable connectors are needed in order to splice together cables having different diameters. Therefore, there is a need for the coaxial cable connector to accommodate cables of different diameter dielectric material.

The present invention attempts to remedy the drawbacks of the prior art and provide a simpler, less expensive device which is easier to assemble, enables to accommodate cables of different diameters and maintains the quality of radio and video reception.

SUMMARY OF THE INVENTION

It is therefore, the principal object of the present invention to provide an improved in-line cable connection suitable for use with a radio or video receptive antenna.

It is also an object of the present invention to allow the simple connection of two coaxial cables that have been simply transversely cut straight through wherein the end of the cable remains flush.

It is also an object of the invention to provide a means to secure a cable to the connector wherein a collapsible sleeve is mounted about the connector and a projection engages the connector to prevent relative rotation.

It is also an object of the invention to provide a coaxial in-line connector which requires no specialized tool other than a simple cutting tool to cut the ends of the cables in order to splice the cables together.

Further object of this invention is to provide a coaxial in-line connector which enables the simple connection of coaxial cables of two different diameters.

DESCRIPTION OF THE PREFERRED EMBODIMENT

Figure 1:
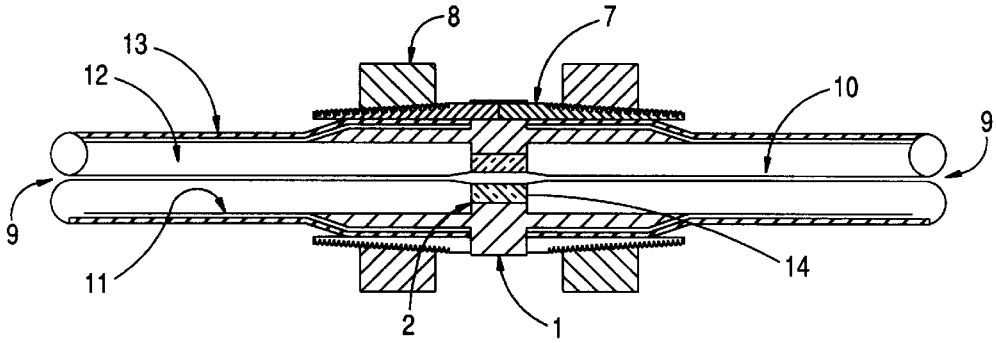
FIG. 1 is a longitudinal sectional view of the in-line connector connecting two coaxial cables.

Referring to FIGS. 1–7 in detail, one embodiment of the cable joint of the present invention is depicted in FIG. 1, showing the joining of two coaxial cables 9. A pair of cables 9 each have an inner conductor 10 concentrically embedded within a dielectric material 12 which is in turn concentrically surrounded by a woven metallic sheath 11 which is in turn is concentrically surrounded by an insulating material 13. The ends of the cables are generally flush cut to define a generally flat transverse area as shown in FIG. 1 at 14. The flush cut end of each cable lies adjacent to an exposed portion of the connector 1 and insulator 2.

Figure 2:
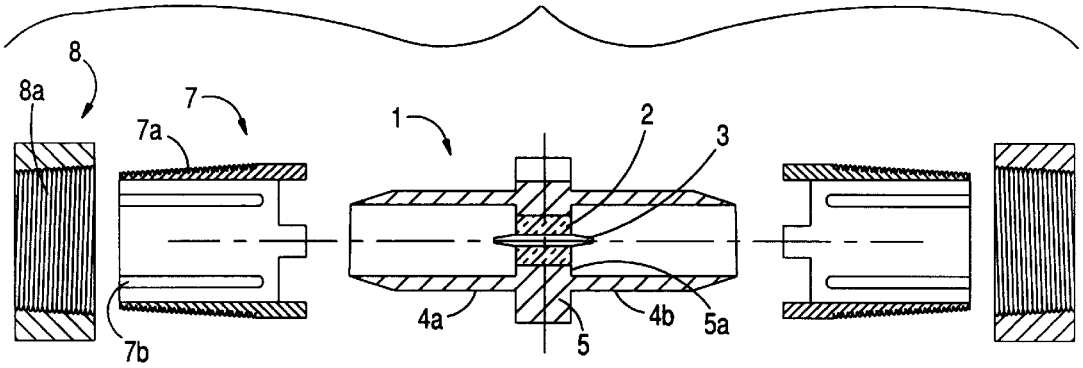
FIG. 2 is an exploded longitudinal sectional view of the in-line connector.
Figure 3:
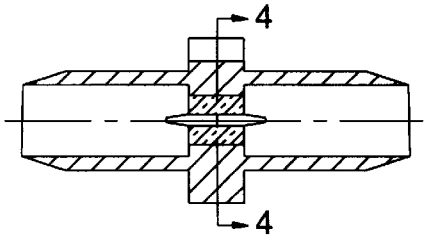
FIG. 3 is a longitudinal sectional view of the interface connector.
Figure 4:
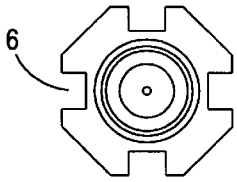
FIG. 4 is a transverse sectional view of the interface connector taken along line 4—4 of FIG. 3.
Figure 5:
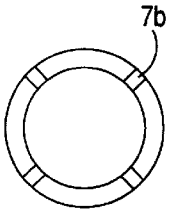
FIG. 5 is an end view of the collapsible sleeve taken along line 5—5 of FIG. 6.
Figure 6:
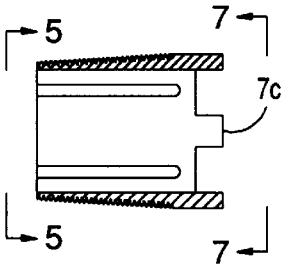
FIG. 6 is a longitudinal sectional view of the collapsible sleeve.
Figure 7:
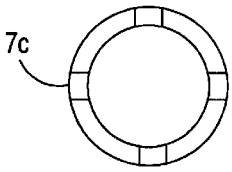
FIG. 7 is an end view of the collapsible sleeve taken along line 7—7 of FIG. 6.

Now referring to FIG. 2, an interface connector 1 has a centrally located nut portion 5 which has an annular inward extending portion 5*a*, the axis of which defines a common longitudinal axis. Within the annular inward extending portion 5*a* of the nut portion 5 are coaxially disposed an insulator 2 and a conductor 3. The width of the insulator 2 is substantially equal to the width of the annular inward extending portion 5*a* so as to provide a generally planer or flat exposed surface. The conductor member 3 is of such a width that when centrally disposed within insulator 2 it extends beyond the insulator on both sides. This extended portion of the conductor member 3 provides an exposed surface to contact the inner conductor member 10 of the cables 9 which are to be spliced together. The length that the conductor 3 extends from the insulator is such as to afford a good contact with the inner conductor 10 of the cable 9 while allowing the transverse surface area of the cable to rest next to the generally planar surface defined by the insulator 2 and inwardly extending portion of the central nut portion 5.

From the central nut portion 5 extends a pair of metallic sleeves 4*a* and 4*b*. Sleeves 4*a*, 4*b* are coaxially aligned with the common axis, defined by the axis of the annular extending portion 5*a*, and extend in opposite directions from the central nut portion 5. The diameter of each of the metallic sleeves 4*a* and 4*b* is substantially the same as the diameter of woven metallic sheath 11 of the coaxial cables 9 so as to make good contact therebetween. The diameter of the metallic sleeves 4*a* and 4*b* can hence be either slightly larger or slightly smaller than the woven metallic sheath 11.

In order to splice two coaxial cables together each cable 9 is completely severed in a direction transverse to its axis to expose a flush end surface. The cable 9 and the interface connector 1 are coaxially aligned and then simply pushed toward one another such that one side of the interface connector is inserted into one of the cables. The cable 9 and connector 1 are displaced toward one another such that the exposed flush surface of the cable rests against or near the generally planar surface defined by the insulator and inward extending portion of central nut 5 as shown at 14. The connector conductor 3 extends into the dielectric material 12 to make contact with the inner conductor 10 of cable 9. The metallic sleeves 4*a* and 4*b* extend into the cable 9 and surround the dielectric material and make contact with the metallic sheath 11 of the cable 9. The diameter of the metallic sleeve is such that it either makes contact with the inner peripheral surface or the outer peripheral surface of the metallic sheath 11 while being disposed within the cable insulator 13. The connection between each of the inner conductors 10 of each cable 9 is made through the conductor member 3 of the interface conductor 1. The connection between the woven metallic sheath 11 of each cable 9 is made through the two metallic sleeves 4*a* and 4*b* and the central nut portion 5 of the interface connector 1. The central nut portion 5 and the metallic sleeves 4*a* and 4*b* are integrally formed of a material such as copper, or the like, to afford a good connection. The connection is thus established between each coaxial cable.

In order to secure the connection of each cable 9 to the interface cable 1, a collapsible sleeve 7 and a locknut 8 are provided. At one end of the collapsible sleeve 7 a portion is threaded on its outer peripheral surface 7*a*. Longitudinal slits 7*b* are cut along this threaded portion 7*a* of sleeve 7 so that the threaded portion 7*a* can expand and contract to accommodate cables of varying diameter. At the other end of sleeve 7 extend a plurality of projections 7*c* which extend in the longitudinal direction. Central nut portion 5 of the interface connector has a plurality of longitudinal notches 6 extending along its entire width parallel to the commonly defined axis. These notches 6 correspond to each of the projecting portions 7*c* of the collapsible sleeve 7. Each projection portion 7*c* is inserted into a corresponding notch 6 in order to prevent relative rotation between the interface connector 1 and the collapsible sleeve 7. A lock nut 8 having a threaded internal surface 8*a* threadingly engages the external surface 7*a* of the collapsible sleeve 7 such that as the lock nut 8 is tightened the diameter of the threaded portion of the collapsible sleeve 7*a* is decreased.

The assembly and securement of the connection will now be described. Once each cable 9 has been flush cut, the locknut 8 and then the collapsible sleeve 7 are slid over each cable 9. The collapsible sleeve 7 is disposed over the cable, and consequently over the insulator portion 13 thereof, such that the projecting portions 7*c* extend toward the flush cut end of the cable 9. One end of the interface connector 1 is coaxially aligned with one of the cables 9 and the two are simply urged toward one another such that one end of the interface connector 1 is inserted into the cable 9. The collapsible sleeve 7 is slid up towards the interface connector 1 until the projecting portions 7*c* of the collapsible sleeve extend into a corresponding notch 6 of the central nut portion to prevent relative rotation therebetween. The lock nut 8 is then slid up to and threadably engages the collapsible sleeve 7. The locknut 8 is tightened so as to reduce the diameter of the collapsible sleeve 7 to crimp the insulator portion 13 of cable 9 against one of the metallic sleeves 4*a* or 4*b*. This crimping action affords a tight friction connection and prevents the cable 9 from dislodging from the interface connector 1. This crimping action additionally, urges the woven the metallic sheath 11 of cable 9 against the external surface of the metallic sleeves 4*a* and 4*b* to afford a better connection therebetween. Once one cable 9 is secured, the same process is repeated for the other cable to the other side of the interface connector 1; a stable in-line electrical connection between each cable has thus been established.

In an alternate method of assembly two longitudinal cuts may be made into the insulator portion 13 to ease the insertion of the metallic sleeves 4*a* and 4*b* within the insulator portion 13 and over the dielectric material 12. These two cuts preferably are spaced 180° apart so as to be opposite one another. The length of these cuts would be sufficient to allow the insulator portion to expand slightly to ease the insertion of the metallic sleeve over the dielectric material 12 and within the insulator portion 13. Additionally, the length of the cuts should not exceed the width of the sleeve 7 so as to ensure that neither the metallic sheath 11 nor the metallic sleeve is exposed to the environment after complete assembly of the connector. When cutting the insulator portion longitudinally, the depth of the cut should not exceed the thickness of the insulator portion in order to preserve the integrity of the woven metallic sheath 11 and dielectric material 12.

Figure 8:
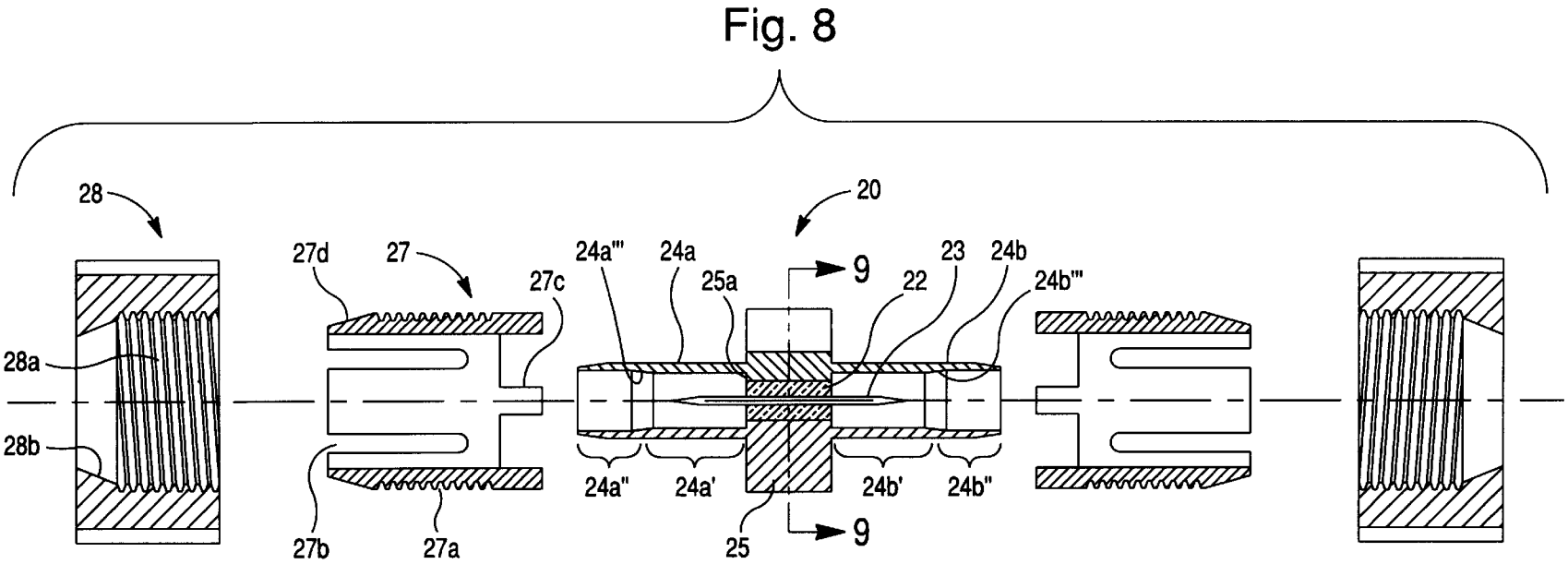
FIG. 8 is an exploded longitudinal sectional view of the preferred embodiment of the in-line connector.
Figure 9:
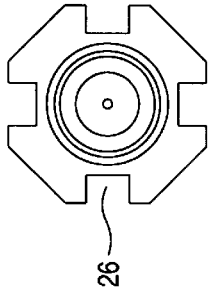
FIG. 9 is a transverse sectional view of the interface connector taken along line 9—9 of FIG. 8.

Referring now to FIG. 8 that illustrates the preferred embodiment of the present invention, an interface connector 20 has a centrally located nut portion 25 which has an annular inward extending portion 25*a*, the axis of which defines a common longitudinal axis. An insulator 22 and a conductor 23 are coaxially disposed within the annular inward extending portion 25*a* of the nut portion 25. The width of the insulator 22 is substantially equal to the width of the annular inward extending portion 25*a* so as to provide a generally planer or flat exposed surface. The conductor member 23 is of such a width that when centrally disposed within insulator 22 it extends beyond the insulator on both sides. This extended portion of the conductor member 23 provides an exposed surface to contact the inner conductor member 10 of the cables 9 which are to be spliced together. The length that the conductor 23 extends from the insulator is such as to afford a good contact with the inner conductor 10 of the cable 9 while allowing the transverse surface area of the cable to rest next to the generally planar surface defined by the insulator 22 and inwardly extending portion of the central nut portion 25.

From the central nut portion 25 extends a pair of metallic sleeves 24*a* and 24*b*. Sleeves 24*a*, 24*b* are coaxially aligned with the common axis, defined by the axis of the annular extending portion 25*a*, and extend in opposite directions from the central nut portion 25. The exterior diameter of the metallic sleeves 24*a* and 24*b* can be either slightly larger or slightly smaller than the diameter of the woven metallic sheath 11. Each of said sleeves 24*a*, 24*b* comprises two sections having different interior diameters in order to accommodate two different types of coaxial cables having dielectric material 12 of different diameters: a first section 24*a*', 24*b*' adjacent to the central nut portion 25, and a second section 24*a*", 24*b*" adjacent to the first sections 24*a*' and 24*b*'. An interior diameter of the first section 24*a*', 24*b*' is smaller than an interior diameter of said second section 24*a*", 24*b*" so that the first section 24*a*', 24*b*' accommodates large diameter cables, while the second section 24*a*", 24*b*" accommodates smaller diameter cables. A ramp section 24*a*'", 24*b*'" of varying internal diameter is located between the first section 24*a*', 24*b*' and the second section 24*a*", 24*b*", providing smooth transition between those first and second sections. In order to secure the connection of each cable 9 to the interface cable 20, a collapsible sleeve 27 and locknut 28 are provided. At one end of the collapsible sleeve 27 a portion is threaded on its substantially cylindrical outer peripheral surface 27*a* and an exterior end portion 27*d* of the collapsible sleeve 27 is tapered. Longitudinal slits 27*b* are cut along the threaded portion 27*a* and the tapered portion 27*d* of the sleeve 27 so that the portion of the sleeve 27 can expand and contract to accommodate cables of varying diameter. At the other end of sleeve 27 a plurality of projections 27*c* are provided which extend in the longitudinal direction. The central nut portion 25 of the interface connector has a plurality of longitudinal notches 26 extending along its entire width parallel to the commonly defined axis. These notches 26 correspond to each of the projecting portions 27*c* of the collapsible sleeve 27. Each projection portion 27*c* is inserted into a corresponding notch 26 in order to prevent relative rotation between the interface connector 20 and the collapsible sleeve 27. A locknut 28 has a threaded internal surface 28*a* at one end of the locknut 28 and an internal inwardly tapered surface 28*b* at the other end. The interior diameter of the internal inwardly tapered surface 28*b* progressively decreases toward said other end of the locknut 28. The threaded internal surface 28*a* of the locknut 28 threadingly engages the external threaded surface 27*a* of the collapsible sleeve 27 such that as the locknut 28 is tightened, the internal tapered surface 28*b* of the locknut 28 engages exterior tapered portion 27*d* of the collapsible sleeve 27 and the diameter of the threaded portion of the collapsible sleeve 27*a* is decreased positively clamping the insulator portion 13 of the cable 9 against the external surface of the sleeves 24*a* and 24*b*.

The assembly and securement of the connection in accordance with the preferred embodiment of the invention will now be described. Once each cable 9 has been flush cut, the locknut 28 and then the collapsible sleeve 27 are slid over each cable 9. The collapsible sleeve 27 is disposed over the cable, and consequently over the insulator portion 13 thereof, such that the projecting portions 27*c* extend toward the flush cut end of the cable 9. One end of the interface connector 20 is coaxially aligned with one of the cables 9 and the two are simply urged toward one another such that one end of the interface connector 20 is inserted into the cable 9. If the cable of small diameter is employed, it engages the first sections 24*a*', 24*b*' of the metallic sleeves 24*a* and 24*b*. However, when the cable of large diameter is employed, it engages the second sections 24*a*", 24*b*" of the metallic sleeves 24*a* and 24*b*. Then the collapsible sleeve 27 is slid up towards the interface connector 20 until the projecting portions 27*c* of the collapsible sleeve extend into a corresponding notch 26 of the central nut portion to prevent relative rotation therebetween. The lock nut 28 is then slid up to and threadably engages the collapsible sleeve 27. The locknut 28 is tightened so as to engage its internal tapered surface 28*b* with the external tapered portion 27*d* of the collapsible sleeve 27 and reduce the diameter of the collapsible sleeve 27 to crimp the insulator portion 13 of cable 9 against one of the metallic sleeves 24*a* or 24*b*. This crimping action affords a tight friction connection and prevents the cable 9 from dislodging from the interface connector 20. This crimping action additionally, urges the woven the metallic sheath 11 of cable 9 against the external surface of the metallic sleeves 24*a* and 24*b* to afford a better connection therebetween. Once one cable 9 is secured, the same process is repeated for the other cable to the other side of the interface connector 20; a stable in-line electrical connection between each cable has thus been established.

The preferred method of assembly and securement of the cable connection in accordance with the alternative embodiment of the invention, is substantially identical to one that was described above in connection with the first embodiment of the present invention.

While the coaxial cable connector of this invention has been shown and described with reference to the particular embodiments, it will be understood to those possessing skill in the art that various changes to the form and detail may be made therein without departing from the spirit and scope of the invention.

What is claimed is:

1. A connector for connecting together two flush cut coaxial cables, each cable comprising an inner conductor and an outer conductor concentric and spaced apart therefrom, said connector comprising:

an interface connector having two coaxially aligned metallic sleeves, each sleeve capable of receiving a cable, and an axial conductor member extending from one sleeve to the other which contacts each of said inner conductors of each of said cables to form an electrical connection therebetween; each of said sleeves including a first section and a second section adjacent to said first section, wherein an interior diameter of said first section is smaller than an interior diameter of said second section;

a locking mechanism adapted to secure each cable to said connector, said locking mechanism including:

a pair of collapsible sleeves each mounted concentrically about one of said cables, said sleeves each having two ends, an externally threaded surface located at one end and at the other end a device to prevent relative rotation between said collapsible sleeve and said connector, and a pair of locknuts having an internally threaded surface each mounted about one of said collapsible sleeves and threadably engaged thereto, wherein when said locknuts are tightened the diameter of said collapsible sleeves is reduced to clamp down on said cable.

2. A connector as recited in claim 1 wherein said device to prevent relative rotation between each said collapsible sleeve and said connector includes:

at least one projection extending from said one end of said collapsible sleeve; and at least one notch formed on said connector for receiving said at least one projection and preventing relative rotation therebetween.

3. A connector as recited in claim 1, wherein each of said collapsible sleeves has an external tapered portion at the one end of said collapsible sleeve, having progressively decreasing diameter of the external surface of said sleeve toward said end, and each of said locknuts having at the one end an internal tapered section of progressively decreasing internal diameter toward said end of said locknut, so as when said locknut is tightened said internal tapered section of said locknut engages said external tapered portion of said collapsible sleeve.

4. A connector for connecting together two flush cut coaxial cables, each cable comprising an inner conductor and an outer conductor spaced apart therefrom having a dielectric material disposed therebetween and an insulating material concentrically disposed thereabout, said connector comprising:

an interface connector having:

a central nut portion having an external surface and an inwardly extending annular member, having a length, the axis of which defines a common longitudinal axis;

two coaxially aligned metallic sleeves extending in opposite directions from said nut portion and concentric with said common longitudinal axis each having an exterior diameter substantially the same as said outer conductor of said cable; each of said sleeves including a first section adjacent to said central nut portion, and a second section adjacent to said first section, wherein an interior diameter of said first section is smaller than an interior diameter of said second section;

a conductor member concentrically and longitudinally centrally disposed within and spaced apart from said central nut portion aligned with said common axis, said conductor member having a diameter substantially equal to said inner conductor of said cable and a length greater than said length of said inwardly extending annular member;

an annular insulator disposed between said inwardly extending annular member of said central nut portion and said conductor member providing electrical insulation therebetween;

a pair of collapsible sleeves each mounted concentrically about one of said metallic sleeves, said sleeves each having two ends, an externally threaded surface located at one end and at the other end at least one projection extending into said at least one notch of said nut portion to prevent relative rotation therebetween; and a pair of locknuts having an internally threaded surface each mounted about one of said collapsible sleeves and threadably engaged thereto wherein when said locknut is tightened the diameter of said collapsible sleeve is reduced.

5. A connector as recited in claim 4, wherein each of said collapsible sleeves has an external tapered portion at the one end having progressively decreasing diameter of the external surface of said sleeve toward said end, and each of said locknuts having an internal tapered section of progressively decreasing interior diameter at one end of said locknut so as when said locknut is tightened said internal tapered section of said locknut engages said external tapered portion of said collapsible sleeve.

6. A connector as recited in claim 4, wherein said annular insulator has a length substantially equal to said length of said inwardly extending annular member.

7. A connector as recited in claim 4, wherein said central nut portion includes at least one longitudinal notch cut into said external surface.

8. A connector as recited in claim 4, wherein said metallic sleeves and said central nut portion are integrally formed.

9. A connector as recited in claim 7, wherein said insulator of said cable is disposed between said collapsible sleeve and said metallic sleeve, and when said locknut is tightened said insulator is clamped between said collapsible sleeve and said metallic sleeve.

10. An interface connector for a coaxial cable connector for connecting together two flush cut coaxial cables, each cable comprising an inner conductor and an outer conductor spaced apart therefrom having a dielectric material disposed therebetween and an insulating material concentrically disposed thereabout, said interface connector comprising:

a central nut portion having an external surface and an inwardly extending annular member, having a length, an axis of which defines a common longitudinal axis;

two coaxially aligned metallic sleeves extending in opposite directions from said nut portion and concentric with said common longitudinal axis each having a diameter substantially the same as said outer conductor of said cable; each of said sleeves including a first section adjacent to said central nut portion, and a second section adjacent to said first section, wherein an interior diameter of said first section is smaller than an interior diameter of said second section;

a conductor member concentrically and longitudinally centrally disposed within and spaced apart from said central nut portion aligned with said common axis, said conductor member having a diameter substantially equal to said inner conductor of said cable and a length greater than said length of said inwardly extending annular member;

an annular insulator disposed between said inwardly extending annular member of said central nut portion and said conductor member providing electrical insulation therebetween.

11. An interface connector for a coaxial cable connector as recited in claim 10, in combination with:

a pair of collapsible sleeves each mounted concentrically about one of said metallic sleeves, said collapsible sleeves each having two ends, an externally threaded surface located at a first end and at a second end at least one projection extending into said at least one notch of said nut portion to prevent relative rotation therebetween; each of said collapsible sleeves has an external tapered portion at the first end having progressively decreasing diameter of the external surface of said sleeve toward said first end; and a pair of locknuts having an internally threaded surface each mounted about one of said collapsible sleeves and threadably engaged thereto, wherein when said locknut is tightened said internal tapered section of said locknut engages said external tapered portion of said collapsible sleeve reducing the diameter of said collapsible sleeve.

* * * * *